US005405500A

United States Patent [19]

Knight

[11] Patent Number: 5,405,500

[45] Date of Patent: Apr. 11, 1995

[54] METHOD FOR MAKING SHEET MATERIALS AND SECURITY PAPER

[75] Inventor: Malcolm R. M. Knight, Basingstoke, United Kingdom

[73] Assignee: Portals Limited, Basingstoke, United Kingdom

[21] Appl. No.: 56,942

[22] Filed: May 5, 1993

Related U.S. Application Data

[63] Continuation of Ser. No. 788,127, Nov. 5, 1991, abandoned.

[30] Foreign Application Priority Data

Oct. 25, 1991 [GB] United Kingdom ..... 9122694

[51] Int. Cl.[6] ..... D21H 5/10

[52] U.S. Cl. ..... 162/103; 162/110; 162/140; 162/268; 162/314; 162/322

[58] Field of Search ..... 162/103, 110, 140, 268, 162/295, 296, 322, 108, 117, 314; 283/91, 904

[56] References Cited

U.S. PATENT DOCUMENTS

| | | | |
|---|---|---|---|
| 4,462,867 | 7/1984 | Fuller | 162/103 |
| 4,534,398 | 8/1985 | Crane | 162/140 |
| 4,943,093 | 7/1990 | Melling et al. | 283/91 |

FOREIGN PATENT DOCUMENTS

| | | | |
|---|---|---|---|
| 0059056 | 9/1982 | European Pat. Off. . | |
| 0166189 | 1/1986 | European Pat. Off. . | |
| 0229645 | 1/1987 | European Pat. Off. . | |
| 0367520 | 5/1990 | European Pat. Off. . | |
| 2408304 | 9/1975 | Germany | 162/322 |
| 161314 | 11/1957 | Sweden | 162/108 |
| 741675 | 12/1955 | United Kingdom . | |
| 1447933 | 9/1976 | United Kingdom . | |
| 1552853 | 9/1979 | United Kingdom . | |
| 1604463 | 12/1981 | United Kingdom . | |

*Primary Examiner*—Peter Chin

*Attorney, Agent, or Firm*—Watson, Cole, Grindle & Watson

[57] ABSTRACT

This invention relates to a method of making sheet materials and security paper having partially embedded therein an elongate security element which is at least substantially exposed at one surface of the sheet at a plurality of spaced locations, which method comprises the steps of depositing fibres onto a moving support surface, supplying an elongate security element to overlie rotatable embedment means, which embedment means comprise a plurality of spaced-apart raised portions having recesses therebetween, introducing the security element into the fibres with rotation of the embedment means such that some fibres move into said recesses between the security element and the embedment means so that said security element is covered by fibres, and substantially preventing fibres from penetrating between the raised portions and the overlying security element.

6 Claims, 1 Drawing Sheet

METHOD FOR MAKING SHEET MATERIALS AND SECURITY PAPER

This application is a continuation of application Ser. No. 788,127, filed Nov. 5, 1991, now abandoned.

FIELD OF THE INVENTION

This invention relates to a method of making sheet materials and security paper having partially embedded therein an elongate security element which is partially disposed within the thickness of the sheet and exposed at spaced locations.

THE PRIOR ART

Bank notes and other security documents including cheques, warrants, identification cards, credit cards or guarantee cards formed from security paper or materials incorporating such partially exposed security strips or threads have been in circulation for a number of years and are now widely used in many countries. The security strip or thread in such documents is exposed in a controlled manner on one side of the paper from which the document is formed. Such exposed regions are commonly referred to as "windows" in the paper and the exposed regions of the thread are readily visible in reflected light at these windows.

British patent specification GB-A-741,675 discloses a Fourdrinier type papermaking machine which is used to produce corrugated paper having some raised and some recessed portions. British patent specification GB-A-1,447,933 teaches a further adapted Fourdrinier type papermaking machine utilising an endless foraminous belt supporting embossed portions for producing a watermark which have areas of different thicknesses. European patent specification EP-A-0,367,520 discloses another papermaking machine of the Fourdrinier type construction which uses differential compaction asserted by a dandy roll carrying embossed watermark designs to create watermarks in the paper produced thereon. Although these prior art specifications demonstrate ways of creating paper with variable thicknesses on Fourdrinier type machines, none of them discloses apparatus or methods for producing windowed security paper incorporating a security element.

European patent specification EP-A-0,166,189 discloses a technique for forming paper by simultaneous drainage through a rotating cylinder and an outer wire but does not disclose a technique for forming windowed paper.

British patent specifications GB-A-1,552,853 and GB-A-1,604,463 disclose windowed security paper in which a security device is embedded within the paper. The windows are created by laser burning, mechanical cutting or abrasive means, which method involves multistep processes, which are costly and time consuming.

European patent specification EP-A-0059056 also relates to a method of making such windowed security paper. In the specification a method is proposed for depositing fibres on the mesh cylinder of a cylinder mould papermaking machine, which rotates in a vat of papermaking fibres. An elongate security thread is fed into contact with the cylinder which has raised portions thereon so that the thread overlies the raised portions as fibres begin to deposit on the cylinder. Fibres are progressively deposited on the cylinder, over the thread and also below the level of the thread except where it is in contact with the raised portions. A disadvantage of this prior technique is that for the range of substances (78–90 grams per square meter) and manufacturing speeds (20–80 m/min) commonly used for banknote paper, the width of security threads which may be incorporated into paper is restricted to less than 3 mm. Above this width, there is insufficient fibre deposition behind the thread since the deposition and thus formation of paper takes place through the cylinder on which the thread is laid and this deposition cannot efficiently occur across the full width of a wide security thread. The resulting paper produced by this method has the thread exposed at one surface of the paper where the thread contacted a raised portion and is continuously covered on the other side of the paper.

EP-A-0,229, 645 additionally discloses a method of combining two wet webs of paper with regions of few or no fibres in one or more of the layers of paper, and inserting a security element into the paper such that the security element embedded beneath the layer or layers is exposed at windowed portions in the finished sheet. However, this requires a very high degree of lateral registration between the security element insertion apparatus and the pre-formed regions containing few or no fibres; such registration is extremely difficult to achieve in practice.

U.S. Pat. No. 4,534,398 relates to method of making security paper incorporating a number of discrete security elements which are pressed into a web of wet based paper fibres formed on a Fourdrinier type moving wire. The discrete security elements are mounted on a carrier paper which, on contacting the wet base fibres, draw some fibres and water up within the carrier paper to form a composite paper. This specification does not disclose any means for exposing a continuous security element in windows on one side of the sheet.

It is an object of the invention to overcome the aforementioned disadvantages and to achieve a method of making windowed sheet materials and security paper incorporating an elongate security element using modifications of paper making apparatus, such as a Fourdrinier machine.

SUMMARY OF THE INVENTION

The present invention provides a method of making a sheet of material generally incorporating an elongate security element which is at least substantially exposed at one surface of the sheet at a plurality of spaced locations, which method comprises the steps of depositing fibres onto a moving support surface, supplying an elongate security element to overlie rotatable embedment means, which embedment means comprise a plurality of spaced-apart raised portions having recesses therebetween, introducing the security element into the fibres with rotation of the embedment means such that some fibres move into the recesses between the security element and the embedment means so that the security element is covered by fibres, and substantially preventing fibres from penetrating between the raised portions and the overlying security element.

Inter alia, the present technique permits manufacture of banknote paper containing wide windowed security threads at higher speeds than is possible using prior techniques.

The preferred embodiment of the invention comprises a method of making a sheet of material generally incorporating a continuous security element which is at least substantially exposed at one surface of the sheet at a plurality of spaced locations, which method comprises the step of depositing fibres onto a continuous moving foraminous support, supplying a continuous security element to overlie a rotatable cylinder, which cylinder comprises a plurality of spaced apart raised portions having recesses therebetween, rotating the cylinder in contact with the deposited fibres creating pressure between the cylinder and the support wire, thereby forcing the security element into the fibres, such that some fibres move into the recesses between the security element and the cylinder so that the security element is covered by fibres, and substantially preventing fibres from penetrating between the raised portion and the overlying security element.

The present invention further provides a papermaking machine for making sheets of paper generally incorporating an elongate security element which is at least substantially exposed at one surface of the sheet at a plurality of spaced locations comprising means for depositing fibres onto a support surface, means for supplying an elongate security element to overlie embedment means, which embedment means comprise a plurality of spaced- apart raised portions having recesses therebetween, and rotating the embedment means to introduce the security element into the fibres such that some fibres move into the recesses between the security element the embedment means so that the security element is covered by fibres, and means for substantially preventing fibres from penetrating between the raised portions and the overlying security element.

BRIEF DESCRIPTION OF THE DRAWINGS

The invention will now be described, by way of example, with reference to the accompanying drawings in which.

DETAILED DESCRIPTION OF THE PREFERRED EMBODIMENT

Figure 1:
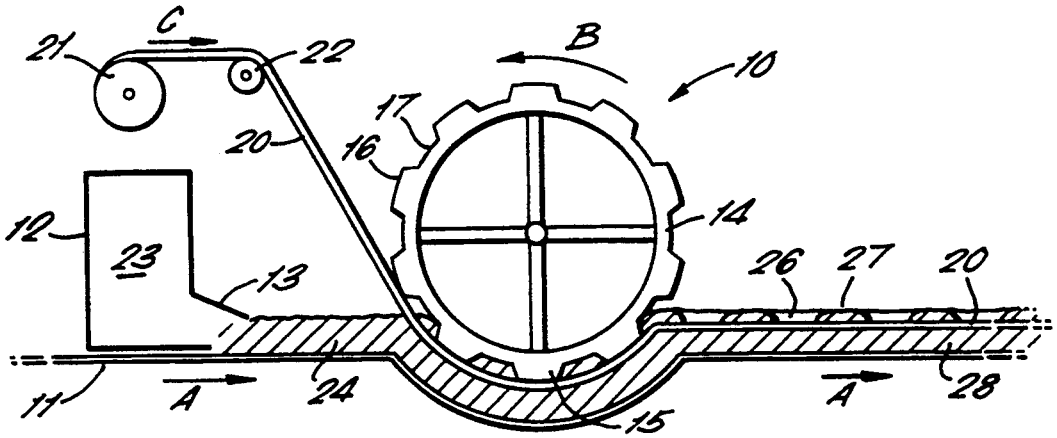
FIG. 1 is a schematic section (not to scale) through a modified Fourdrinier paper machine in normal operation inserting a security thread into the paper being made.
Figure 2:
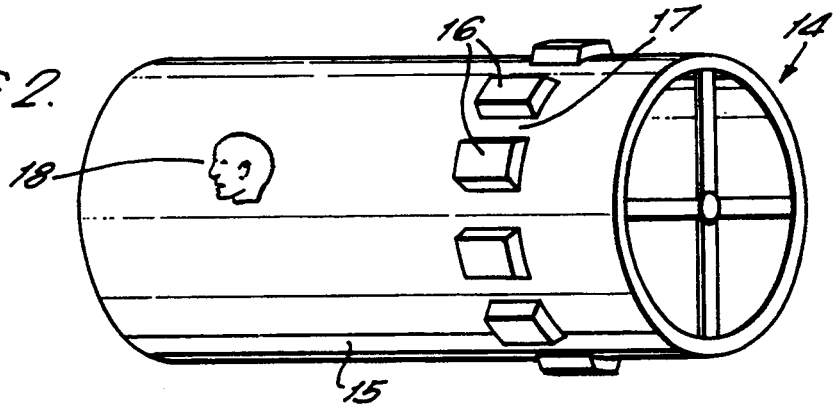
FIG. 2 shows an enlarged perspective view of a cylinder used in the machine of FIG. 1.

Referring to FIGS. 1 and 2 there is shown a modified Fourdrinier type paper making machine 10. The machine 10 comprises an endless foraminous wire 11 which is supported and driven in the direction of arrows A by an appropriate arrangement of rollers or other support and driving means (not shown). A head box 12 containing aqueous fibre stock 23 is located adjacent the wire 11 and has a mouth or slice 13 located directed above the wire 11 to maintain a continuous relatively level supply of the aqueous fibre stock to be fed to the moving wire 11.

A cylinder 14 is positioned above the wire 11 and is driven by appropriate means (not shown) to rotate in the direction of arrow B. The cylinder 14 is covered with a porous wire mesh 15 which is embossed with portions 16, which are raised with respect to the surrounding level of wire mesh 15. The recesses 17 between the raised portions 16 may or may not actually be recessed with respect to the surrounding wire mesh 15, according to the required surface finish of the end product. The regions 16 and recesses 17 extend for typically, but not exclusively, 6–30 mm in a direction parallel to the axis of the cylinder 14 and for 1–15 mm in the circumferential direction. The actual sizes of the regions 16 and recesses 17 are determined by the required size of windows in the resulting paper. Optionally, the wire mesh 15 may also include an additional embossing 18 e.g., in the form of a human portrait, which will create a type of watermark in the final paper if required.

Where the wire 11 passes beneath cylinder 14, the wire 11 follows an arcuate path, to take into account the curvature of the cylinder 14.

The continuous flexible security element in the form of a strip or thread 20 to be fed into the paper, is generally of uniform construction and thickness. Such a thread 20 is typically 12 micron polyester vacuum metallised with aluminium on one or both sides and coated on one of those sides with a protective and/or adhesive material. Obviously other designs or compositions may be used according to the desired end effect. The preferred security strip or thread is typically, but not exclusively, 1–5 mm wide, but again the actual size will depend on the required effect. The thread 20 is fed from a bobbin 21 over a guide mechanism 22 in the direction of arrow C. The guide mechanism 22 is positioned such that the thread 20 makes contact with the raised portions 16 of wire mesh 15 above the level of the paper being formed and maintains tension of the thread.

In operation, aqueous fibrous stock is fed from a supply 23 via the mouth 13 of head box 12 to form a generally even layer 24. Water from the layer of stock 24 drains through the holes in the wire 11, thus leaving fibres deposited on the wire 11 and starting the formation of the sheet of paper. As the wire 11 passes beneath the rotating cylinder 14, the raised portions 16 of the cylinder 14 move the overlying thread 20, which is in contact therewith, down into the fibres 24. Some of the fibres of the draining paper layer 24 are thereby displaced and forced by the pressure between the cylinder 14 and foraminous wire 11 into the recesses 17 of the cylinder between the security thread 20 and the wire mesh 15. The fibres, however, are not able to penetrate between the thread 20 and the wire mesh 15 at the raised portions 16.

Drainage of water from the paper layer 24 continues to take place through the holes of the supporting wire 11. Optionally, further drainage takes place through the wire mesh 15 covering the cylinder 14, although such drainage may need to be assisted by a vacuum extraction system in the region where the cylinder 14 is in contact with the layer 24.

As it is necessary to prevent fibres occurring between the raised portion 16 and the thread 20, the initial point of contact of the thread 20 on the raised portion 16 must take place before the raised portion 16 comes into contact with the layer of fibres 24. Correct tensioning of the thread 20 will ensure that this contact is maintained and prevents the unwanted penetration of fibres accordingly.

Figure 3:
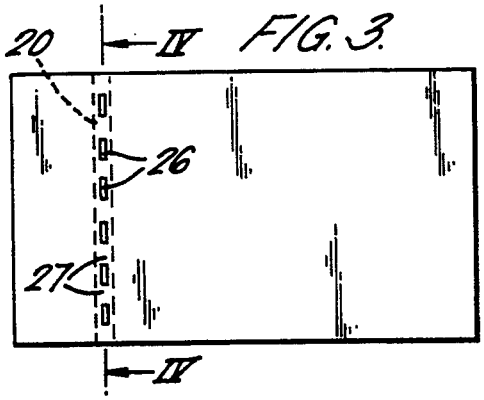
FIG. 3 is a plan view of a finished bank note incorporating a security device made from paper produced by the machine of FIG. 1.
Figure 4:
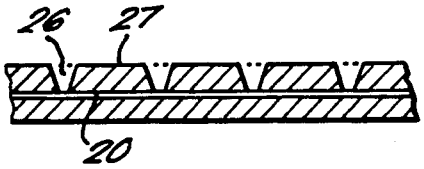
FIG. 4 shows an enlarged portion of the cross section through the bank note of FIG. 3 on the line IV—IV of FIG. 3.

As the partially formed paper 24 on the wire 11 leaves the cylinder 14, the security thread 20 is just exposed on one side at regions 26, which were formerly in contact with the raised portions 16, but is covered with fibres at intervening regions 27. The other side of the thread 20 is fully covered with fibres. Further drainage and consolidation of the sheet of paper continues to take place and conventional press and drying apparatus complete the paper manufacturing process. Following this, the resulting paper is reeled into webs for subsequent finishing and printing operations. The finished paper can be processed to form a bank note 29, such as the one shown in FIG. 3, which has regions 26 on one side where the security thread 20 is exposed in between regions 27 where it is covered. On the other side of the bank notes (not shown) the thread 20 is fully enclosed in fibres.

Using the technique disclosed in this specification, it is possible to produce banknote paper containing a wider security thread (3 mm or more) than is possible using the technique of EP-A-0059056. Firstly, the pressure generated between the rotating cylinder 14 and foraminous wire 11 is effective in forcing fibre between a wide security thread 20 and the recesses 17 thus ensuring full fibre coverage of regions 27 between the windows 26. Secondly, since the paper is essentially formed by drainage through the foraminous wire 11 before and during embedment of the security thread, there is full fibre coverage of the thread on the reverse side of the sheet at 28.

Other modifications may be made to the machine which are as follows.

In one alternative embodiment,, the raised portions 16 on the cylinder 14 comprise a water impermeable substance, such as flexible rubber, bonded onto the wire mesh 15. Alternatively the raised portions 16 may be partially pervious and partially impervious.

In another alternative embodiment, the head box 12 may be placed very close to the nip between the rotating cylinder 14 and the foraminous wire 11 to inject the aqueous stock 23 directly into the nip. Also, the support wire 11, the rotating cylinder 14, or both may be subjected to lateral shaking parallel to the axis of the cylinder 14, to assist the formation of the paper in a manner similar to that of a conventional Fourdrinier machine. Where such shaking is adopted, it is preferable to shake both the wire 11 and the cylinder 14 together in phase. Typically, the guidance mechanism 22 for the security strip 20 is subjected to controlled lateral oscillation with respect to the wire 11 and rotating cylinder 14 in order to oscillate the position of the security strip in the finished paper. This is a conventional procedure, adopted to minimise distortion of the paper web or stack of sheets by the inclusion of the security thread 20 which typically increases the overall thickness of the paper in the region of the thread.

Preferably, the cylinder 14 extends to the full width of the paper machine and wire 11. The same cylinder may have multiple sets of raised portions 16 according to the number of security threads 20 required across the width of the paper web.

Alternatively, the cylinder 14 may be substantially narrower in the axial direction and could be essentially the same width as the raised portion 16. In this embodiment, multiple cylinders 14 may be used across the width of the machine, each containing one series of raised portion 16.

In yet another variant, two or more cylinders 14 are placed across the width of the machine, each providing several series of raised portions 16.

The fibres used to manufacture paper according to this technique may be natural (e.g., cotton, linen, wood) or synthetic (e.g., polyester, viscose, nylon, polyvinyl alcohol) or a mixture of natural/synthetic fibres.

I claim:

1. A method of making a sheet of continuous material incorporating a continuous elongate security element, in which the security element is at least substantially exposed at windows in one surface of the sheet at a plurality of spaced locations and substantially buried within the paper beneath bridges located between said windows, which method comprises the steps of:

(a) depositing aqueous fibrous stock comprising a mixture of water and paper-making fibres onto a smooth support surface which travels in a continuous path in a substantially linear direction, said support surface being foraminous to enable drainage of water from the fibrous stock located thereon;

(b) bringing the continuous elongate security element into contact with rotating window forming means, which window forming means bears a plurality of spaced apart raised portions which are raised relative to adjacent areas of the surface of the window forming means, the raised portions having opposing sides, there being recesses between said raised portions being defined by the sides of adjacent raised portions and a base, said window forming means being located above the support surface and the security element being brought into contact across adjacent raised portions overlying the recesses therebetween, the contact being made above the level of fibrous stock;

(c) pushing the security element down into the deposited fibrous stock by rotation of the window forming means, such that the said raised portions form the windows in the sheet of material and fibres are caused to move into the recesses between the security element and the base surface of the window forming means of the recesses to form said bridges;

(d) applying tension to the elongate security element to maintain contact with the raised portions of the window forming means to prevent said fibres substantially from penetrating between the raised portions and the overlying security element, and (e) continuously removing the sheet of material from the support surface.

2. A method as claimed in claim 1 in which the window forming means comprise a rotating cylinder bearing the spaced areas raised relative to adjacent areas of the surface.

3. A method as claimed in claim 1 in which the raised portions are water permeable, water impermeable or a combination of both.

4. A method as claimed in claim 1 in which the embedment means further comprises a number of sets of raised portions and an equal number of security elements supplied thereto.

5. A method according to claim 1 wherein the fibres consist of natural fibres, synthetic fibres or a combination of both.

6. A method as claimed in claim 1 in which the support surface deviates from its linear path to conform to the general profile of the window forming means where said support surface passes beneath the window forming means.

* * * * *